US007718235B2

(12) United States Patent
Uerz et al.

(10) Patent No.: US 7,718,235 B2
(45) Date of Patent: May 18, 2010

(54) OVERCOAT COMPOSITION FOR IMAGE RECORDING MATERIALS

(75) Inventors: David S. Uerz, Ontario, NY (US); Hwei-Ling Yau, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 693 days.

(21) Appl. No.: 11/678,723

(22) Filed: Feb. 26, 2007

(65) Prior Publication Data

US 2007/0141278 A1 Jun. 21, 2007

Related U.S. Application Data

(62) Division of application No. 10/279,439, filed on Oct. 24, 2002, now Pat. No. 7,219,989.

(51) Int. Cl.
*B41M 5/40* (2006.01)

(52) U.S. Cl. ..... 428/32.1; 428/195.1; 428/201; 428/203; 428/204; 428/500; 428/518; 428/688; 347/95; 347/98; 347/105

(58) Field of Classification Search ..... 428/32.1, 428/195.1, 201, 203, 204, 500, 518, 688; 347/95, 98, 105
See application file for complete search history.

(56) References Cited

U.S. PATENT DOCUMENTS

| | | | | |
|---|---|---|---|---|
| 4,732,786 | A * | 3/1988 | Patterson et al. | 427/261 |
| 4,781,985 | A | 11/1988 | Desjarlais | |
| 5,640,187 | A | 6/1997 | Kasiwazaki et al. | |
| 5,846,699 | A | 12/1998 | Wang et al. | |
| 6,206,586 | B1 | 3/2001 | Wen et al. | |
| 6,543,888 | B2 | 4/2003 | Nishita | |
| 6,561,644 | B2 | 5/2003 | Romano, Jr. et al. | |
| 2002/0009547 | A1 | 1/2002 | Ito et al. | |
| 2002/0065339 | A1 | 5/2002 | Gore | |
| 2003/0018120 | A1 * | 1/2003 | Lee et al. | 524/543 |
| 2004/0135864 | A1 * | 7/2004 | Ogino et al. | 347/100 |

FOREIGN PATENT DOCUMENTS

| | | |
|---|---|---|
| EP | 1 145 865 | 10/2001 |
| EP | 1 186 439 | 3/2002 |
| GB | 2 337 482 | 11/1999 |

* cited by examiner

*Primary Examiner*—Betelhem Shewareged
(74) *Attorney, Agent, or Firm*—Chris P. Konkol

(57) ABSTRACT

The invention relates to an overcoat composition for an imaged image-recording element, the overcoat composition comprising an aqueous carrier, an optional humectant, an optional surfactant, and 0.05 to 20 weight percent, based on the total weight of the overcoat composition, of an addition polymer having an acid number greater than about 110. The invention also relates to a method of making an imaged image recording element having a transparent overcoat, which method comprises forming an image on the image recording element and applying over the image an overcoat composition of the present invention.

The overcoat compositions of the invention provide advantageous stain resistance.

20 Claims, No Drawings

OVERCOAT COMPOSITION FOR IMAGE RECORDING MATERIALS

CROSS-REFERENCE TO RELATED APPLICATIONS

This is a divisional of application Ser. No. 10/279,439, filed Oct. 24, 2002 now U.S. Pat. No. 7,219,989.

FIELD OF THE INVENTION

The present invention relates to image recording materials. More particularly, the present invention relates to a protective overcoat that provides excellent stain resistance for printed images.

BACKGROUND OF THE INVENTION

Ink jet printing is a non-impact method for producing images by the deposition of ink droplets in a pixel-by-pixel manner to an image-recording element in response to digital signals. There are various methods which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

Printed images generated using ink jet technology are subject to environmental degradation. They are especially vulnerable to damage resulting from contact with aqueous solutions and atmospheric gases such as ozone. The damage resulting from post-imaging contact with aqueous solutions can take the form of water spots resulting from deglossing of the top coat, dye smearing due to unwanted dye diffusion, and even gross dissolution of the image-recording layer. Ozone destroys ink jet dyes resulting in loss of density.

Several methods for minimizing the effects of environmental degradation are well known in the art of ink jet printing. Printed images may be laminated with a clear overcoat film. However, lamination is expensive as it requires a separate roll of material, and it is often time consuming and difficult to evenly apply the film to the printed image without any creases or pockets of trapped air.

Another method for minimizing the effects of environmental degradation requires the use of an ink jet recording element that is fused using heat and/or pressure after the image has been printed. These fusible inkjet recording elements typically have a construction of at least two layers coated on a support wherein the top layer is porous and consists mainly of polymeric particles. Upon printing, the ink is transported through the top layer and into at least one layer underneath. The printed image is then fused and the polymeric particles in the porous top layer soften and form a continuous nonporous layer that resists water and staining. However, this method is expensive because it requires specially designed ink jet recording elements and an integral or peripheral fusing station.

Another method for minimizing the effects of environmental degradation is to apply a coating of a polymeric solution or dispersion on the surface of the printed image using a brush, roller, sponge, etc. A protective overcoat forms as the solution or dispersion dries. However, this method is considered too impractical and undesirable for use by the typical consumer.

Another method for protecting printed images from environmental degradation is the application of a polymeric solution or dispersion to the printed image using an ink jet printer. This method has been described for use in ink jet printers used in desktop and wide-format graphic applications and mostly for printers which utilize aqueous-based inks. The polymeric solutions, also known as overcoat solutions, are formulated with polymer, water, and other components commonly used in aqueous-based ink jet ink formulations, for example, humectants, organic solvents, surfactants and biocides. The overcoat solution is loaded into an ink jet printhead, positioned in the carriage assembly of the printer and then instructed to jet the overcoat solution over the printed image.

U.S. Pat. App. 2002/0009547 A1 describes a coating liquid and image recording method that provides a transparent topcoat for recordings. The topcoat is formed by jetting an aqueous solution of fine polymer particles onto a recorded image. The fine polymer particles are present in the form of an aqueous emulsion made up of a resin or resins having an acid value of 100 or less and being insoluble in water. The problem with this coating liquid is that the resulting topcoat is not as resistant to common household stains as one would like, as will be shown hereafter.

U.S. Pat. No. 5,640,187 describes an ink jet recording method having a step in which a solution containing a resin having an acid value of 30 to 100 and soluble in alkali is discharged to a recording member prior to or after the ink is discharged. However, Applicants have found that a film formed from such a resin is not as resistant to common household stains as one would like, as will be shown hereafter.

U.S. Pat. App. 2002/0065339 A1; G.B. Pat. App. 2,337,482 A and European Pat. App. 1,186,439 A1 describe compositions that are used to overcoat ink jet recorded images using an ink jet printer. While these applications describe the use of acidic polymers, they do not teach that the acid number of a polymer can be used to predict its performance as an overcoat.

It is an object of the present invention to provide an overcoat composition that can be applied over a printed image. It is another object of the present invention to provide an overcoat composition that forms a protective film on a printed image and is highly resistant to staining. Yet another object of the present invention is to provide a protected printed image that is highly resistant to a variety of aqueous-based solutions. Such an overcoat composition is applicable to various image recording elements, including, for example, ink jet, photographic, electrophotographic, thermal dye transfer, thermographic and lithographic.

SUMMARY OF THE INVENTION

These and other objects are achieved in accordance with the present invention which relates to an overcoat composition comprising an addition polymer having an acid number greater than about 110. In one embodiment, the overcoat composition comprises an aqueous carrier, an optional humectant, an optional surfactant, and 0.05 to 20 weight percent, based on the total weight of the overcoat composition, two or more addition polymers, wherein the acid number of all of said addition polymer is greater than about 110, which acid number is based on the arithmetic average or mean of the acid numbers of all of the one or more addition polymers in the overcoat composition. The invention also relates to a method of making an imaged image recording element having a transparent overcoat, which method comprises forming an image on the image recording element and applying over the image an overcoat composition of the present invention. The overcoat compositions of the invention provide relatively advantageous stain resistance.

DETAILED DESCRIPTION OF THE INVENTION

The present invention employs at least one addition polymer formed from a mixture of vinyl or unsaturated monomers. In one embodiment, the mixture of monomers includes styrenic monomers. Preferred styrenic monomers include, but are not limited to, α-alkylstyrenes, trans-β-alkylstyrenes, alkylstyrenes, alkoxystyrenes, halogenated styrenes, vinyl naphthalenes and mixtures thereof. Specific examples of styrenic derivatives include styrene, α-methylstyrene, trans-β-methylstyrene, 3-methylstyrene, 4-methylstyrene, 3-ethyl styrene, 3-isopropyl styrene, 3-butyl styrene, 3-cyclohexyl styrene, 3,4-dimethyl styrene, 3-chlorostyrene, 3,4-dichloro styrene, 3,4,5-trichloro styrene, 3-bromo styrene, 3-iodo styrene, 3-fluoro styrene, 3-chloro-4-methyl styrene, benzyl styrene, vinyl naphthalene, divinylbenzene, methyl vinylbenzoate ester, vinylbenzoic acid, vinyl phenol, 3-methoxy styrene, 3,4-dimethoxy styrene, 3-methyl-4-methoxy styrene, acetoxystyrene, acetoxymethylstyrene and (t-butoxycarbonyloxy) styrene. The styrenic monomers may be substituted with ionic functionalities such as sulfonate and carboxylate. Specific examples include sodium styrenesulfonate and sodium vinylbenzoate.

In another embodiment, the mixture of monomers includes acrylic monomers. The term "acrylic monomer" as employed herein includes acrylic acid, acrylate esters and derivatives and mixtures thereof. Examples of acrylic acid monomers include but are not limited to alkylacrylic acids, 3-alkylacrylic acids and 3-haloacrylic acids. Specific examples include crotonic acid, cinnamic acid, citraconic acid, sorbic acid, fumaric acid, methacrylic acid, ethacrylic acid, 3-methylacrylic acid, 3-chloroacrylic acid and 3-chloromethacrylic acid.

Examples of acrylate esters include but are not limited to alkyl acrylates, aryl acrylates, alkyloxyalkyl acrylates, alkyloxyaryl acrylates, hydroxyalkyl acrylates, hydroxyaryl acrylates, crotonic esters, cinnamic esters, citraconic esters, sorbic esters and fumaric esters. Specific examples include n-butyl acrylate, methyl acrylate, ethyl acrylate, n-propyl acrylate, isopropyl acrylate, amyl acrylate, hexyl acrylate, n-octyl acrylate, lauryl acrylate, 2-chloroethyl acrylate, phenyl acrylate, benzyl acrylate, allyl acrylate, methyl 3-chloroacrylate, 2-ethylhexyl acrylate, 2-methoxyethyl acrylate, 2-(2-methoxyethoxy)ethyl acrylate, 2-ethoxyethyl acrylate, 2-(2-ethoxyethoxyl)ethyl acrylate, 2-hydroxyethyl acrylate, 2-hydroxypropyl acrylate, glycidyl acrylate, N,N-dimethylaminoethyl acrylate, trifluoroethyl acrylate, 2-sulfoethyl acrylate and the corresponding methacrylates.

Acrylic monomers useful in the present invention also include unsaturated anhydride and unsaturated imide monomers which may be completely or partially hydrolyzed after polymerization to form the corresponding carboxylic acid or amide functionality. Specific examples include but are not limited to maleic anhydride, methylmaleic anhydride, glutaconic anhydride, itaconic anhydride, citraconic anhydride, mesaconic anhydride, maleimide and N-methylmaleimide. Also useful are mono-ester and bis-ester derivatives of the aforementioned.

Other monomers useful in the present invention include acrylamide and derivatives such as but not limited to N-alkyl acrylamides, N-aryl acrylamides and N-alkoxyalkyl acrylamides. Specific examples include N-methyl acrylamide, N-ethyl acrylamide, N-butyl acrylamide, N,N-dimethyl acrylamide, N,N-dipropyl acrylamide, N-(1,1,2-trimethylpropyl) acrylamide, N-(1,1,3,3-tetramethylbutyl) acrylamide, N-methoxymethyl acrylamide, N-methoxyethyl acrylamide, N-methoxypropyl acrylamide, N-butoxymethyl acrylamide, N-isopropyl acrylamide, N-s-butyl acrylamide, N-t-butyl acrylamide, N-cyclohexyl acrylamide, N-(1,1-dimethyl-3-oxobutyl) acrylamide, N-(2-carboxyethyl) acrylamide, 3-acrylamido-3-methyl butanoic acid, methylene bisacrylamide, N-(3-aminopropyl) acrylamide hydrochloride, N-(3,3-dimethylaminopropyl) acrylamide hydrochloride, N-(1-phthalamidomethyl) acrylamide, sodium N-(1,1-dimethyl-2-sulfoethyl) acrylamide and the corresponding methacrylamides.

Besides being derived from styrenic and acrylic monomers, the addition polymers useful in the present invention may have functionality derived from a variety of other types of monomers well known in the art of polymer chemistry. Such monomers include vinyl derivatives and ethylenically unsaturated compounds in general. Examples of these other monomer types include but are not limited to olefins (e.g., dicyclopentadiene, ethylene, propylene, 1-butene, 5,5-dimethyl-1-octene, etc.); halogenated olefins (e.g., vinyl chloride, vinylidene chloride, etc.); α-alkylalkenes, acrylonitriles, acroleins, vinyl ethers, vinyl esters, vinyl ketones, vinylidene chloride compounds, allyl compounds, and ethylenically unsaturated heterocyclic compounds. Specific examples include allyl acetate, allyl caproate, methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycolvinyl ether, dimethylaminoethyl vinyl ether, butylaminoethyl vinyl ether, benzyl vinyl ether, tetrahydrofurfuryl vinyl ether, vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, N-vinyl oxazolidone, N-vinylimidazole, N-vinylpyrrolidone, N-vinylcarbazole, vinyl thiophene and N-vinylethyl acetamide.

The addition polymers useful in the present invention may be derived from monomers capable of absorbing UV light after polymerization. Examples of such monomers are disclosed and claimed in U.S. patent application Ser. No. 09/999,469 filed Oct. 31, 2001 the disclosure of which is incorporated herein by reference. A variety of other types of monomers well known in the art of polymer chemistry can be used. Still other monomer types include multifunctional monomers having some combination of functionality described above.

Cross-linkable functional groups well known in the art of polymer chemistry may also be imparted to any one of the monomers described above, either before or after polymerization. The addition polymer employed in the invention is then generated by reaction of the cross-linkable functional groups under conditions well known in the art of polymer chemistry. The addition polymer employed in the invention may be derived from multi random copolymer, a block copolymer, a graft copolymer, or an alternating copolymer.

Preferably, the addition polymer is a styrene-acrylic copolymer comprising a mixture of vinyl or unsaturated monomers, including at least one styrenic monomer and at least one acrylic monomer, at least one of which monomers has an acid or acid-providing group. Any addition polymer can be used in the present invention provided it has an acid number greater than about 110 and can be stabilized in an aqueous medium, particularly an aqueous basic medium. Such polymers are disclosed in, for example, U.S. Pat. Nos. 4,529,787; 4,358,573; 4,522,992; 4,546,160; the disclosures of which are incorporated herein by reference. Preferred polymers include, for example, styrene-acrylic acid, styrene-acrylic acid-alkyl acrylate, styrene-maleic acid, styrene-maleic acid-alkyl acrylate, styrene-methacrylic acid, styrene-methacrylic acid- alkyl acrylate, and styrene-maleic acid half ester, wherein each type of monomer may correspond to one or more particular monomers. Examples of preferred polymers include but are not limited to styrene-acrylic acid copolymer, (3-methyl styrene)-acrylic acid copolymer, styrene-methacrylic acid copolymer, styrene-butyl acrylate-acrylic acid terpolymer, styrene-butyl methacrylate-acrylic acid terpolymer, styrene-methyl methacrylate-acrylic acid terpolymer, styrene-butyl acrylate-ethyl acrylate-acrylic acid tetrapolymer and styrene-(α-methylstyrene)-butyl acrylate-acrylic acid tetrapolymer.

In one embodiment, the styrene-acrylic polymer comprises at least one acrylic monomer that is functionalized with a carboxylic acid group. The relative amounts of monomers used is not particularly limited, as long as the styrene-acrylic polymer has an acid number greater than about 110. Preferred combinations and relative amounts of monomers are described in the references listed in the previous paragraph.

When used herein, the term "acid number", also known as "acid value", is defined by the number of milligrams of potassium hydroxide required to neutralize one gram of polymer. Thus, the acid number of a given polymer is related to the percent of acid-containing monomer or monomers. The higher the acid number, the more acid functionality is present in the polymer. It is well known that the acid number can be obtained by titrating a solution of the polymer, in the presence of an indicator such as phenolphthalein, with a dilute solution of potassium hydroxide.

In a preferred embodiment, an overcoat composition comprising two or more addition polymers has an average or mean acid number or greater than 110, preferably between 110 and 300, wherein the mean acid number is the arithmetic average or mean of the acid numbers of all of the two or more addition polymers in the overcoat composition. In such a case, the acid number of at least one addition polymer in the overcoat is also greater than about 110.

Thus, for example, a mixture of two addition polymers can be used, one with a relatively high acid number (>110) and the other with a relatively low acid number (<110). The monomers in the two polymers can be the same, with different proportions, or the monomers can be different in the two polymers.

The addition polymer employed in the present invention may be either water-soluble, water-reducible or water-dispersible. By the term "water-soluble" is meant herein that the polymer is dissolved in water such that scattering is not observed when a dilute solution of the polymer is analyzed using dynamic light scattering or any other technique well known in the art of particle analysis.

By the term "water-reducible" is meant herein that the polymer can be diluted with water to form reasonably stable dispersions of polymer aggregates swollen by solvent and water, as described in "Organic Coatings: Science and Technology" (2nd Edition by Wicks, Jones and Papas, published by Wiley-Interscience, 1999). Such polymers have hydrophilic groups in some monomers, but are not water soluble until neutralized by base.

By the term "water-dispersible" is meant herein that the polymer exists in the form of particles in water, the particles being dispersed or suspended and often stabilized against flocculation and settling by the use of dispersing agents. In contrast to a water-soluble polymer, a dilute solution of a water-dispersible polymer exhibits scattering when analyzed using dynamic light scattering or any other technique well known in the art of particle analysis.

Before preparing the overcoat composition, a solution or dispersion of the addition polymer is typically prepared by neutralization of the polymer using inorganic or organic bases such as alkali metal hydroxides, ammonia, mono-, di- and trialkyl- or aryl amines; nitrogen-containing heterocycles; and tetraalkyl-or aryl amines and the like. Specific examples of bases include sodium hydroxide, potassium hydroxide, lithium hydroxide, ammonia, triethylamine, triethanolamine, diethanolamine, 4-ethylmorpholine or dimethylethanolamine. The amount of base used can from 30 to 105 mole % based on the acid groups in polymer. The identity and amount of base used is dependent on the desirable viscosity, jettability through printhead and print durability and other properties delivered by the overcoat composition of the present invention. In a preferred embodiment of the invention, an inorganic base such as sodium hydroxide or potassium hydroxide is used. In another preferred embodiment, the amount of base used is at least about 70 mole % based on the acid groups in the polymer.

The molecular weights of the addition polymers used in the invention must be high enough to impart chemical durability to the resulting film but low enough such that the corresponding overcoat compositions are jettable using an ink jet printhead. A preferable weight average molecular weight range is from about 2000 to about 300,000. An even more preferable weight average molecular weight range is from about 2000 to about 100,000; especially preferable is a weight average molecular weight range of from about 2000 to about 50,000.

Addition polymers useful in the present invention are commonly prepared by free radical polymerization of vinyl or ethylenically unsaturated monomers; however, other polymerization methods such as anionic polymerization, cationic polymerization, polyinsertion, and others well known in polymerization chemistry are also suitable. Synthetic techniques well known in the art of polymer chemistry include but are not limited to emulsion polymerization, solution polymerization, suspension polymerization and dispersion polymerization.

The following commercially available styrene-acrylic polymers may be employed in the overcoat composition of the invention, for example, styrene-acrylic polymer having acid number 240, sold as Joncryl® 70 from S.C. Johnson Co. (Wisconsin, USA); a styrene-acrylic polymer having acid number 230 sold as TruDot™ IJ-4655 from MeadWestvaco Corp. (Stanford, Conn., USA); a styrene-acrylic polymer having acid number 215 sold as Joncryl® 59 from S.C. Johnson Co.; a styrene-acrylic polymer having acid number 215 sold as Joncryl® 57 from S.C. Johnson Co.; a styrene-acrylic polymer having acid number 213 sold as Joncryl® 63 from S.C. Johnson Co.; a styrene-acrylic polymer having acid number 172 sold as TruDot® IJ-4680 from MeadWestvaco Corp.; an acrylic resin having acid number 160 sold as Vancryl® 68S from Air Products and Chemicals, Inc. (Allentown, Pa.).

The addition polymer is present in the overcoat composition in an amount required to give a protective overcoat of desired water and stain resistance after the overcoat composition has been printed and dried. By the term "stain resistance" is meant herein that, after printing, the imaged recording element does not imbibe water or has a protective overcoat that prevents or minimizes water-based stains from discoloring the imaged side of the imaged-recording element. Furthermore, the overcoat thickness, or dry laydown of polymer, is not particularly limited, and is determined not only by the inherent capacity of that polymer to function as a protective overcoat, but also by numerous other factors, for example, the other components present in the overcoat composition, resolution and drop size capacity of the printhead, print speed, masking pattern, etc., as well as the properties of the ink and image-recording element used to form the printed image. In general, the addition polymers described above comprise from about 0.05 to about 20 wt. %, preferably from about 0.5 to about 10 wt. %, more preferably from about 1 to about 5 wt. % of the overcoat composition. The overcoat thickness is not particularly limited, but is preferably up to about 4 μm, and more preferably up to about 2 μm.

A humectant may be employed in the ink jet overcoat composition to help prevent the overcoat composition from drying out or crusting in the orifices of the printhead. Examples of humectants which can be used include polyhydric alcohols, such as ethylene glycol, diethylene glycol, triethylene glycol, propylene glycol, tetraethylene glycol, polyethylene glycol, glycerol, 2-methyl-2,4-pentanediol, 2-ethyl-2-hydroxymethyl-1,3-propanediol, 1,5 pentanediol, 1,2-hexanediol, 1,2,6-hexanetriol and thioglycol; lower alkyl mono- or di-ethers derived from alkylene glycols, such as ethylene glycol mono-methyl or mono-ethyl ether, diethylene glycol mono-methyl or mono-ethyl ether, propylene glycol mono-methyl or mono-ethyl ether, triethylene glycol mono-methyl, mono-ethyl or mono-butyl ether, diethylene glycol di-methyl or di-ethyl ether, poly(ethylene glycol) monobutyl ether, and diethylene glycol monobutylether; nitrogen-containing compounds, such as urea, 2-pyrrolidinone, N-methyl-2-pyrrolidinone, and 1,3-dimethyl-2-imidazolidinone; and sulfur-containing compounds such as 2,2'-thiodiethanol, dimethyl sulfoxide and tetramethylene sulfone.

Preferred humectants for the ink jet overcoat composition of the invention include diethylene glycol, glycerol, 1,2-hexanediol, 1,5-pentanediol, urea, 2-pyrrolidinone, 2-ethyl-2-hydroxymethyl-1,3-propanediol, diethylene glycol monobutyl ether, triethylene glycol monobutyl ether and mixtures thereof. The humectant may be employed in each overcoat composition in an amount up to about 70 wt. %.

Water-miscible organic solvents may also be added to the ink jet overcoat composition in order to help the overcoat composition penetrate the image recording layer or layers. Examples of such solvents include alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; ketones or ketoalcohols such as acetone, methyl ethyl ketone and diacetone alcohol; ethers, such as tetrahydrofuran and dioxane; and esters, such as, ethyl lactate, ethylene carbonate and propylene carbonate. The humectant may be employed in each overcoat composition in an amount up to about 70 wt. %

The amount of aqueous carrier (including water, solvents, cosolvents, and humectants) employed in the invention is in the range of approximately 75 to 99.9 wt. %, preferably approximately 90 to 98 wt. %, based on the total weight of the overcoat composition. A mixture of water and a polyhydric alcohol, such as diethylene glycol, is useful as an aqueous carrier. Percentages are based on the total weight of the overcoat composition.

Surfactants may be added to the overcoat compositions to adjust the surface tension to an appropriate level. The surfactants may be anionic, cationic, amphoteric or nonionic and used at levels of up to about 1 wt. % of the overcoat composition. Preferred surfactants include Surfynol® 465 (Air Products Corp.), Tergitol® 15-S-5 (Union Carbide) and Silwet® L-77 (Osi Specialties, Inc.).

A biocide may be added to the ink jet overcoat compositions to suppress the growth of microorganisms such as molds, fungi, etc. A preferred biocide for the overcoat composition employed in the present invention is Proxel® GXL (Avecia Corp.) biocide at a final concentration of up to about 0.5 wt. %.

The pH of the ink jet overcoat composition employed in the invention may be adjusted and/or buffered by the addition of inorganic or organic acids or bases. Useful overcoat compositions have a preferred pH of from about 2 to about 10. Especially preferred is a pH of from about 6 to about 10.

Additional additives which may optionally be present in the ink jet overcoat compositions employed in the invention include thickeners, conductivity enhancing agents, anti-kogation agents, drying agents, anti-corrosion agents, defoamers, antioxidants and UV absorbers.

The ink jet overcoat composition of the present invention may be printed on an image which has been generated by just about any imaging means including thermal dye transfer images, ink jet images, photographic images, offset-printed images, gravure images, lithographic images, thermographic images, images made from pressure-sensitive microcapsule media, and similar images In a preferred embodiment, the composition of the present invention is dropwise jettable by means of an ink-jet printhead, spray bar, or atomizer. This can be accomplished, as will be recognized by the skilled artisan, by adjustment of the viscosity, surface tension, and/or, depending on the method of application, printhead interaction. Typically, the overcoat composition, when applied dropwise to an imaged image recording element, are in the form of drops that are on average about 2 picoliters to about 5 milliliters in volume. Preferably, the overcoat composition is applied after the image is fixed or dried.

It is especially desirable to print the ink jet overcoat composition on a printed image that has been generated by ink jet printing. In this case, virtually any combination of ink jet ink composition and image-recording element may be used to prepare the printed image. Ink jet ink compositions, well known in the art of ink jet printing, include both dye-based and pigment-based inks, and either may be used to generate the printed image. Representative examples of such inks are disclosed in U.S. Pat. Nos. 5,997,622; 5,985,017; 5,616,174; 5,738,716; 5,536,306; 4,381,946; 4,239,543; and 4,781,758, the disclosures of which are incorporated herein by reference. A typical ink composition employed in the invention may comprise water, humectants, water miscible co-solvents, surfactants, biocides, etc. The specific ink compositions will vary depending upon the type of ink jet printing system, i.e., depending upon whether the ink jet printhead is a thermal or piezoelectric drop-on-demand printhead, or a continuous printhead.

The overcoat composition of the present invention can be applied to various image-recording elements well known in the art of ink jet printing including both porous and swellable types, and either may be used to generate the printed image. Representative examples of such image-recording elements are disclosed in U.S. Pat. Nos. 6,045,917; 5,605,750; 5,723,211; 5,789,070 and EP 813 978 A1, the disclosures of which are incorporated herein by reference. In a preferred embodiment of the invention, porous image-recording elements are employed because they dry quickly. In another preferred embodiment of the invention, porous image-recording elements having high gloss are employed because they render photographic quality printed images.

The overcoat composition may be applied to an imaged recording element in accordance with the invention either through a separate thermal, piezoelectric or continuous printhead, or by any other method which would apply the overcoat composition evenly to the imaged recording element. Thermal and piezoelectric printheads are preferable, and thermal printheads are especially preferable. Examples of other methods are disclosed in U.S. Pat. Nos. 6,254,230 and 6,176,574, the disclosures of which are incorporated herein by reference.

The overcoat composition can be jetted out, relative to the image-forming colored inks; either in the same or in a separate pass of the printhead, or in a completely separate pass of the printed image through the printer.

An overcoat composition of the present invention can be applied using a conventional type of printhead with the overcoat composition inserted into any one of the regular printhead positions in a carriage assembly or a separate carriage can be attached to the assembly either before, after, ahead of or behind the slots for the ink printheads, so long as the overcoat composition is applied after the image is formed. The printhead for the overcoat composition can be positioned either on or separate from the carriage assembly used to apply the image. Alternatively, the printhead for the overcoat composition can be a spray bar or other device that does not use a carriage assembly, for example, as disclosed in EP application 1048466A2, published Nov. 2, 2000. For example, see the arrangements for applying overcoat compositions disclosed in U.S. Pat. No. 6,412,935 and Japanese kokai JP2000225695A to Seiko Epson, published Aug. 15, 2000, U.S. Pat. No. 6,206,586, EP 1057646A2 published Dec. 12, 2000, and U.S. Pat. No. 6,193,361, all of which references are hereby incorporated by reference in their entirety. A free-standing, stand-alone device or station for applying the overcoat composition to the imaged recording element can also be utilized.

The following example illustrates the utility of the present invention.

EXAMPLE

The following polymeric compositions were prepared for making overcoat compositions according to the present invention:

A. A styrene-acrylic polymer having acid number 240; sold as Joncryl® 70 from S.C. Johnson Co. as a 25-30 wt. % solution in water.

B. A styrene-acrylic polymer having acid number 230; sold as TruDot™ IJ-4655 from MeadWestvaco Corp. as a solid.

C. A styrene-acrylic polymer having acid number 215; sold as Joncryl® 59 from S.C. Johnson Co. as a 30-35 wt. % solution in water.

D. A styrene-acrylic polymer having acid number 215; sold as Joncryl® 57 from S.C. Johnson Co. as a 35-40 wt. % solution in water.

E. A styrene-acrylic polymer having acid number 213; sold as Joncryl® 63 from S.C. Johnson Co. as a 25-30 wt. % solution in water.

F. A styrene-acrylic polymer having acid number 172; sold as TruDot™ IJ-4680 from MeadWestvaco Corp. as a 25-29 wt. % solution in water.

G. An acrylic resin having acid number 160; sold as Vancryl® 68S from Air Products and Chemicals, Inc. as a 25-35 wt. % solution in water.

The following overcoat compositions were made from the above-described polymeric compositions:

Overcoat Composition 1 of the Invention

Overcoat Composition 1 of the invention was prepared using Polymer A described above at 4.5 wt. %, diethylene glycol at 4.5 wt. %, diethylene glycol monobutyl ether at 10.0 wt. % and surfactant Silwet® L-77 (Osi Specialties, Inc.) at 0.45 wt. % in water. The solution was filtered using a membrane with pore size 0.45 μm.

Overcoat Composition 2 of the Invention

A 25 wt. % solution of Polymer B was prepared by mixing the polymer in water containing potassium hydroxide in an amount sufficient to ionize 95% of the carboxylic acid groups. Overcoat Composition 2 of the invention was prepared by as described for Overcoat Composition 1 of the invention except that Polymer B described above was used instead of Polymer A.

Overcoat Composition 3 of the Invention

Overcoat Composition 3 of the invention was prepared as described for Overcoat Composition 1 of the invention except that Polymer C described above was used instead of Polymer A.

Overcoat Composition 4 of the Invention

Overcoat Composition 4 of the invention was prepared as described for Overcoat Composition 1 of the invention except that Polymer D described above was used instead of Polymer A.

Overcoat Composition 5 of the Invention

Overcoat Composition 5 of the invention was prepared as described for Overcoat Composition 1 of the invention except that Polymer E described above was used instead of Polymer A.

Overcoat Composition 6 of the Invention

Overcoat Composition 6 of the invention was prepared as described for Overcoat Composition 1 of the invention except that Polymer F described above was used instead of Polymer A.

Overcoat Composition 7 of the Invention

Overcoat Composition 7 of the invention was prepared as described for Overcoat Composition 1 of the invention except that Polymer G described above was used instead of Polymer A.

The following polymers were used as comparative polymers:

AA. A styrene-acrylic polymer having acid number 108; sold as Joncryl® 56 from S.C. Johnson Co. as a 25-30 wt. % solution in water BB. A styrene-acrylic polymer having acid number 70; sold as Joncryl® 95 from S.C. Johnson Co. as a 25-30 wt. % solution in water The following comparative overcoats were made:

Comparative Overcoat Composition C-1

Comparative Overcoat Composition C-1 was prepared as described for Overcoat Composition 1 of the invention except that Polymer AA was used instead of Polymer A.

Comparative Overcoat Composition C-2

Comparative Overcoat Composition C-2 was prepared as described for Overcoat Composition 1 of the invention except that Polymer BB was used instead of Polymer A.

Image-Recording Elements

The following image-recording elements were used to evaluate the overcoat compositions:

RE-1. Epson Premium Glossy Photo Paper (cat. no. SP91001); available from Epson America, Inc.

RE-2 Kodak Instant-Dry Photographic Glossy Media (cat. no. 8103137);

available from Eastman Kodak Co.

Printing

Overcoat Compositions 1-7 of the invention and Comparative Overcoat Compositions C-1 and C-2 were printed on image-recording elements RE-1 and RE-2 using a Kodak Professional 4860® ink jet printer in the bidirectional mode using a single head and 8 passes. Each composition was loaded into an ink cartridge and a test image consisting of a page-width solid patch (about 10×80 cm) was printed at 100% coverage.

Evaluation of Test Images—Stain Testing

The printed test images were evaluated for stain resistance by immersing each image in an aqueous solution of Ponceau Red dye for 1 minute. (The Ponceau Red dye solution was prepared by dissolving the dye at 0.1 wt. % in a 5 wt. % solution of acetic acid.) the image was rinsed with distilled water and residual liquid removed from the surface by dabbing the test area with lint free tissue. After drying at ambient conditions for 30 minutes, the resulting printed test images were inspected visually and the magenta optical density was measured using Model 820 densitometer from X-Rite®, Inc. These data were used to rank the printed test images from 1=best to 9=worst. The results are tabulated in Table 1.

TABLE 1

| | Acid | RE-1 | | RE-2 | |
|---|---|---|---|---|---|
| Overcoat Composition | Number of Polymer | Stain Density | Overall Ranking | Stain Density | Overall Ranking |
| 1 J | 240 | 0.11 | 4 | 0.07 | 2 |
| 2 H | 230 | 0.11 | 5 | 0.07 | 6 |
| 3 G | 215 | 0.11 | 2 | 0.07 | 4 |
| 4 F | 215 | 0.13 | 6 | 0.07 | 1 |
| 5 E | 213 | 0.11 | 3 | 0.07 | 5 |
| 6 D | 172 | 0.16 | 7 | 0.09 | 7 |
| 7 C | 160 | 0.09 | 1 | 0.07 | 3 |
| C-1 B | 108 | 0.27 | 9 | 0.22 | 9 |
| C-2 A | 70 | 0.21 | 8 | 0.19 | 8 |

The printed test images were further evaluated for stain resistance using yellow mustard (French's®), room temperature coffee and red fruit punch (Hawaiian Punch®). For each printed test image, a 1.5 mL aliquot of each liquid was applied and after 15 minutes at ambient conditions, residual liquid was removed from the surface by dabbing the test areas with lint free tissue. After drying at ambient conditions for 30 minutes, the stains were inspected visually and evaluated as light, medium and dark, and then each printed test image was scored from 1=no stain to 9=highly stained. These values were summed up to give an Overall Stain Score. The results, showing performance on RE-1 and RE-2, are tabulated in Tables 2 and 3, respectively.

TABLE 2

| Overcoat Composition | Acid Number of Polymer | Mustard Stain | Coffee Stain | Punch Stain | Overall Stain Score |
|---|---|---|---|---|---|
| 1 J | 240 | 1 | 1 | 2 | 4 |
| 2 H | 230 | 1 | 1 | 2 | 4 |
| 3 G | 215 | 1 | 1 | 2 | 4 |
| 4 F | 215 | 1 | 1 | 2 | 4 |
| 5 E | 213 | 1 | 1 | 2 | 4 |

TABLE 2-continued

| Overcoat Composition | Acid Number of Polymer | Mustard Stain | Coffee Stain | Punch Stain | Overall Stain Score |
|---|---|---|---|---|---|
| 6 D | 172 | 1 | 1 | 6 | 8 |
| 7 C | 160 | 1 | 1 | 2 | 4 |
| C-1 B | 108 | 7 | 7 | 7 | 21 |
| C-2 A | 70 | 7 | 8 | 7 | 22 |

TABLE 3

| Overcoat Composition | Acid Number of Polymer | Mustard Stain | Coffee Stain | Punch Stain | Overall Stain Ranking |
|---|---|---|---|---|---|
| 1 J | 240 | 1 | 1 | 1 | 3 |
| 2 H | 230 | 1 | 1 | 1 | 3 |
| 3 G | 215 | 1 | 1 | 1 | 3 |
| 4 F | 215 | 1 | 1 | 1 | 3 |
| 5 E | 213 | 1 | 1 | 1 | 3 |
| 6 D | 172 | 1 | 1 | 1 | 3 |
| 7 C | 160 | 1 | 1 | 1 | 1 |
| C-1 B | 108 | 7 | 7 | 9 | 23 |
| C-2 A | 70 | 7 | 7 | 9 | 23 |

The above results show that the overcoat compositions of the invention containing addition polymers with acid numbers greater than about 110 give better stain resistance as compared to the comparative overcoat compositions in which the addition polymers had acid numbers less than about 110.

The invention has been described in detail with particular reference to useful embodiments thereof, but it will be understood that variations and modifications can be effected within the spirit and scope of the invention.

What is claimed is:

1. An imaged inkjet recording element having a transparent substantially colorless overcoat over the image, wherein the overcoat is applied as an overcoat composition comprising an aqueous carrier, an optional humectant, an optional surfactant, and 0.05 to 20 weight percent, based on the total weight of the overcoat composition, of at least one water-soluble addition polymer having an acid number greater than about 110, wherein the at least one water-soluble addition polymer has been neutralized by an amount of base that is at least 30 mole percent based on the acid groups in the polymer.

2. The imaged inkjet recording element of claim 1, wherein the overcoat comprises 0.05 to 20 weight percent, based on the total weight of the overcoat composition, of two or more water-soluble addition polymers, wherein the arithmetic mean of the acid numbers of all addition polymers in the overcoat composition is greater than 110.

3. The imaged inkjet recording element of claim 1, wherein the acid number is between about 110 and about 300.

4. The imaged inkjet recording element of claim 1, wherein the overcoat composition comprises a single water-soluble addition polymer that is the reaction product of mixture of vinyl or unsaturated monomers and which polymer has a hydrophilic group in a portion of the monomers, wherein the water-soluble addition polymer is not water soluble until neutralized by a base.

5. The imaged inkjet recording element of claim 1, wherein the at least one water-soluble addition polymer is a styrene-acrylic acid polymer.

6. The imaged inkjet recording element of claim 1, wherein the at least one water-soluble addition polymer is a styrene-acrylic polymer comprising a mixture of vinyl or unsaturated monomers, including at least one styrenic monomer and at least one acrylic monomer, at least one of which of the styrenic monomer or the acrylic monomer has an acid or acid-providing group, wherein the overcoat composition has been applied dropwise over the image.

7. The imaged inkjet recording element of claim 6, wherein the acid or acid providing group is on the acrylic monomer.

8. The imaged inkjet recording element of claim 6, wherein the at least one water-soluble addition polymer comprises at least one styrenic monomer selected from the group consisting of α-alkylstyrenes, trans-β-alkylstyrenes, alkylstyrenes, alkoxystyrenes, halogenated styrenes, and vinyl naphthalenes.

9. The imaged inkjet recording element of claim 8, wherein the at least one water-soluble addition polymer comprises at least one styrenic monomer selected from the group consisting of styrene, α-methylstyrene, trans-β-methylstyrene, 3-methylstyrene, 4-methylstyrene, 3-ethyl styrene, 3-isopropyl styrene, 3-butyl styrene, 3-cyclohexyl styrene, 3,4-dimethyl styrene, 3-chlorostyrene, 3,4-dichloro styrene, 3,4,5-trichloro styrene, 3-bromo styrene, 3-iodo styrene, 3-fluoro styrene, 3-chloro-4-methyl styrene, benzyl styrene, vinyl naphthalene, divinylbenzene, methyl vinylbenzoate ester, vinylbenzoic acid, vinyl phenol, 3-methoxy styrene, 3,4-dimethoxy styrene, 3-methyl-4-methoxy styrene, acetoxystyrene, acetoxymethylstyrene, (t-butoxycarbonyloxy) styrene, and mixtures thereof, wherein the styrenic monomers may optionally be substituted with ionic functionalities selected from the group consisting of phosphate, sulfonate, and carboxylate.

10. The imaged inkjet recording element of claim 7, wherein the at least one water-soluble addition polymer comprises at least one acrylic monomer selected from the group consisting of acrylic acid monomers and unsaturated anhydride and unsaturated imide monomers which may be completely or partially hydrolyzed after polymerization to form the corresponding carboxylic acid or amide functionality.

11. The imaged inkjet recording element of claim 10, wherein the at least one water-soluble addition polymer comprises at least one acrylic monomer selected from the group consisting of acrylic acid, alkylacrylic acids, 3-alkylacrylic acids, 3-haloacrylic acids, maleic anhydride, methylmaleic anhydride, glutaconic anhydride, itaconic anhydride, citraconic anhydride, mesaconic anhydride, maleimide and N-methylmaleimide, and mono-ester and bis-ester derivatives of the aforementioned.

12. The imaged inkjet recording element of claim 11, wherein the at least one water-soluble addition polymer comprises at least one acrylic monomer selected from the group consisting of crotonic acid, cinnamic acid, citraconic acid, sorbic acid, fumaric acid, methacrylic acid, ethacrylic acid, 3-methylacrylic acid, 3-chloroacrylic acid, and 3-chloromethacrylic acid.

13. The imaged inkjet recording element of claim 1, wherein the at least one water-soluble addition polymer comprises at least one acrylate ester selected from the group consisting of alkyl acrylates, aryl acrylates, alkyloxyalkyl acrylates, alkyloxyaryl acrylates, hydroxyalkyl acrylates, hydroxyaryl acrylates, crotonic esters, cinnamic esters, citraconic esters, sorbic esters, and fumaric esters.

14. The imaged inkjet recording element of claim 1, wherein the at least one water-soluble addition polymer comprises at least one styrene-acrylic polymer that comprises at least one acrylic monomer that is functionalized with a carboxylic acid group.

15. The imaged inkjet recording element of claim 1, wherein the at least one water-soluble addition polymer in solution has been prepared by neutralization of the polymer using an inorganic base.

16. The imaged inkjet recording element of claim 1, wherein the base is an alkali metal hydroxide or ammonia.

17. The imaged inkjet recording element of claim 1, wherein the base is an inorganic base selected from the group consisting of sodium hydroxide, potassium hydroxide, lithium hydroxide, and the amount of base used is at least about 70 mole % based on the acid groups in the at least one water-soluble addition polymer.

18. The imaged inkjet recording element of claim 1, wherein the base is an organic base selected from the group consisting of ammonia, mono-, di- and trialkyl- or aryl amines; nitrogen-containing heterocycles; tetraalkyl- or aryl amines, and combinations thereof.

19. The imaged inkjet recording element of claim 1, wherein the at least one water-soluble addition polymer has a weight average molecular weight range of from about 2000 to about 300,000.

20. The imaged inkjet recording element of claim 19 wherein the weight average molecular weight is from about 2,000 to about 100,000.

* * * * *